US007477277B2

(12) United States Patent
Sasaki et al.

(10) Patent No.: US 7,477,277 B2
(45) Date of Patent: Jan. 13, 2009

(54) HEAT-DISSIPATING MEMBER AND THERMAL HEAD ATTACHED TO HEAT-DISSIPATING MEMBER

(75) Inventors: Tsuneyuki Sasaki, Fukushima-ken (JP); Hirotoshi Terao, Fukushima-ken (JP); Tomoko Wauke, Fukushima-ken (JP); Hisashi Hoshino, Fukushima-ken (JP); Junichi Sato, Fukushima-ken (JP); Shinji Okawara, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 362 days.

(21) Appl. No.: 11/303,110

(22) Filed: Dec. 15, 2005

(65) Prior Publication Data

US 2006/0132586 A1 Jun. 22, 2006

(30) Foreign Application Priority Data

Dec. 20, 2004 (JP) ..... 2004-368187

(51) Int. Cl.
*B41J 29/377* (2006.01)
*F28D 1/02* (2006.01)

(52) U.S. Cl. ..... 347/223; 165/152

(58) Field of Classification Search ..... 347/223
See application file for complete search history.

(56) References Cited

U.S. PATENT DOCUMENTS

| | | | | |
|---|---|---|---|---|
| 4,899,210 | A * | 2/1990 | Lorenzetti et al. | 257/712 |
| 5,099,914 | A * | 3/1992 | Reifel | 165/151 |
| 2007/0193730 | A1 * | 8/2007 | Ozaki | 165/140 |

FOREIGN PATENT DOCUMENTS

| | | |
|---|---|---|
| JP | 5-36873 | 2/1993 |
| JP | 2002-144616 | 5/2002 |

* cited by examiner

*Primary Examiner*—Huan H Tran
(74) *Attorney, Agent, or Firm*—Brinks Hofer, Gilson & Lione

(57) ABSTRACT

A heat-dissipating member includes a heat-dissipating section which is plate-shaped and which is attachable to a heat source directly or indirectly and also includes a plurality of heat-dissipating projections extending from the heat-dissipating section. The heat-dissipating projections are formed by louvering the heat-dissipating section so as to have predetermined heights. The heat-dissipating projections are arranged in increasing order of height in the direction from one end of the heat-dissipating section to an end of the heat-dissipating section that is opposed to the one end. A thermal head includes a plurality of heating elements arranged thereon and a head mount attached to the above heat-dissipating member directly or indirectly.

8 Claims, 3 Drawing Sheets

HEAT-DISSIPATING MEMBER AND THERMAL HEAD ATTACHED TO HEAT-DISSIPATING MEMBER

BACKGROUND OF THE INVENTION

1. Field of the Invention

The present invention relates to heat-dissipating members and thermal heads attached to such heat-dissipating members. The present invention particularly relates to a heat-dissipating member for dissipating the heat of a thermal head heated a high temperature during printing and also relates to a thermal head attached to a heat-dissipating member.

2. Description of the Related Art

A known thermal head will now be described using a thermal transfer printer disclosed in Japanese Unexamined Patent Application Publication No. 2002-144616 (hereinafter referred to as Patent Document 1).

With reference to FIG. 7, the thermal transfer printer 31 includes a head mount 33 and a thermal head 32 mounted thereunder.

The head mount 33 is made of metal such as aluminum and attached to a left end portion of a head lever 34.

The head lever 34 includes a support section 34*a* located on the right end thereof and is swingable about the support section 34*a*.

The thermal head 32 includes a plurality of heating elements (not shown) arranged under the lower face thereof. A rotatable platen roller 35 is disposed below the lower face of the thermal head 32. The swing of the head lever 34 about the support section 34*a* allows the thermal head 32 to be brought into contact with or separated from the platen roller 35, that is, the swing allows the thermal head 32 to be kept in a head-up mode or a head-down mode.

A recording sheet 36 and an ink ribbon 37 are fed between the thermal head 32 and the platen roller 35.

A rotatable sheet-feeding roller 38 and a pressing roller 39 pressed against the sheet-feeding roller 38 are arranged on the left side of the platen roller 35. The recording sheet 36 fed between the thermal head 32 and the platen roller 35 can be moved in the direction indicated by Arrow A or B in such a manner that the sheet-feeding roller 38 is driven with a motor (not shown).

The operation of the thermal transfer printer 31 including the known thermal head 32 will now be described. A ribbon cassette (not shown) containing the ink ribbon 37 is mounted on a cassette-mounting section (not shown) in such a manner that the thermal head 32 is kept in the head-up mode, whereby the ink ribbon 37 is fed between the raised thermal head 32 and the platen roller 35.

The recording sheet 36 is fed below the ink ribbon 37 and the recording sheet 36 and the ink ribbon 37 are then pinched between the sheet-feeding roller 38 and the pressing roller 39.

While the recording sheet 36 and the ink ribbon 37 are being fed, the recording sheet 36 and the ink ribbon 37 are pressed against the platen roller 35 by lowering the thermal head 32 and the heating elements are selectively allowed to generate heat depending on printing data.

The sheet-feeding roller 38 is driven simultaneously with the above operation such that the recording sheet 36 and the ink ribbon 37 are moved in the direction indicated by Arrow A, whereby ink on the ink ribbon 37 is thermally transferred to the recording sheet 36, so that a desired image is printed on the recording sheet 36.

If the thermal head 32 is heated to a high temperature by heat generated from the heating elements during printing, the heat is dissipated from the head mount 33.

The thermal head 32 has a problem that the thermal head 32 is heated to a temperature higher than a predetermined temperature and the heat dissipation from the head mount 33 is insufficient if a plurality of printing sheets are continuously subjected to printing.

In order to solve such a problem, a known plate-shaped heat-dissipating member (not shown) made of a metal material, such as aluminum, having high heat conductivity may be attached to the head mount 33. In order that the thermal head 32 heated to a temperature higher than a predetermined temperature by continuous printing is cooled such that normal printing can be performed, the known heat-dissipating member must have a large heat dissipation area. Therefore, the known heat-dissipating member has a problem that the size thereof is large and the material cost thereof is high. Furthermore, the thermal head 32 including the known heat-dissipating member has a problem that the size thereof is large.

SUMMARY OF THE INVENTION

In order to solve the above problems, it is an object of the present invention to provide a heat-dissipating member that has a small size but a large heat dissipation area so as to dissipate the heat of a thermal head heated to a high temperature. It is another object of the present invention to provide a thermal head including such a heat-dissipating member.

A heat-dissipating member according to the present invention includes a heat-dissipating section which is plate-shaped and which is attachable to a heat source directly or indirectly and also includes a plurality of heat-dissipating projections extending from the heat-dissipating section. The heat-dissipating projections are formed by louvering the heat-dissipating section so as to have predetermined heights.

The heat-dissipating projections are preferably arranged in increasing order of height in the direction from one end of the heat-dissipating section to an end of the heat-dissipating section that is opposed to the one end.

The heat-dissipating projections are preferably arranged in N rows parallel to the one end of the heat-dissipating section and arranged in increasing order of height in the direction from the one end of the heat-dissipating section to the opposed end thereof such that the heat-dissipating projections present in an Nth row located close to the opposed end are taller than the heat-dissipating projections present in a first row located close to the one end.

The heat-dissipating projections preferably make different tilt angles with respect to the heat-dissipating section, are arranged in increasing order of tilt angle in the direction from the one end of the heat-dissipating section to the opposed end such that the heat-dissipating projections located close to the opposed end make a right angle with respect to the heat-dissipating section, and are arranged in increasing order of height in the direction from the one end of the heat-dissipating section to the opposed end.

The heat-dissipating projections present in the first row preferably make a tilt angle of 45 degrees with respect to the heat-dissipating section and the heat-dissipating projections present in the Nth row preferably make a right angle with respect to the heat-dissipating section.

The heat-dissipating projections present in the N rows adjacent to each other are preferably arranged alternately.

A thermal head according to the present invention includes a plurality of heating elements arranged thereon and a head mount attached to the above heat-dissipating member directly or indirectly.

In the thermal head, an air blower is preferably disposed near the one end of the heat-dissipating section and air is preferably applied to the heat-dissipating projections, arranged in increasing order of height in the direction from the one end of the heat-dissipating section to the opposed end, from the air blower, whereby the heat-dissipating section and then the head mount are cooled.

The heat-dissipating section preferably has openings formed by forming the heat-dissipating projections and the head mount is preferably exposed through the openings directly or indirectly and cooled by the air fed from the air blower through the openings.

Since the heat-dissipating member has the above configuration, the heat-dissipating section has a large heat dissipation area because of the presence of the heat-dissipating projections; hence, high-temperature heat conducted from the heat source can be efficiently dissipated from the heat-dissipating member and the heat source can therefore be cooled to a predetermined temperature.

Since the heat-dissipating projections are arranged in increasing order of height as described above, air can be uniformly applied to the heat-dissipating projections using an air blower disposed on the side of the one end of the heat-dissipating section.

Since the heat-dissipating projections are arranged in increasing order of tilt angle as described above, the height of the heat-dissipating projections can be varied by changing the tilt angle thereof; hence, the heat-dissipating member can be readily manufactured.

Since the heat-dissipating projections present in the first row make a tilt angle of 45 degrees with respect to the heat-dissipating section and the heat-dissipating projections present in the Nth row make a right angle with respect to the heat-dissipating section, the heat-dissipating projections present in the first row have a height suitable to receive the air fed from the air blower.

Since the heat-dissipating projections present in the N rows adjacent to each other are arranged alternately, the air fed from the air blower can be uniformly applied to the heat-dissipating projections and the heat source can therefore be efficiently cooled.

The thermal head of the present invention has the above configuration, the heat of the thermal head heated to a high temperature during printing can be efficiently dissipated from the heat-dissipating member; hence, a high-quality image can be printed by dissipating the heat from the heat-dissipating member even if the thermal head is heated a high temperature during continuous printing.

Since the air blower is used, the thermal head heated a high temperature can be properly cooled, whereby a high-quality image can be printed.

Since the heat-dissipating section has the openings, the head mount is cooled by air fed from the air blower through the openings; hence, the thermal head heated a high temperature can be properly cooled to a predetermined temperature during printing.

DESCRIPTION OF THE PREFERRED EMBODIMENTS

Figure 1:
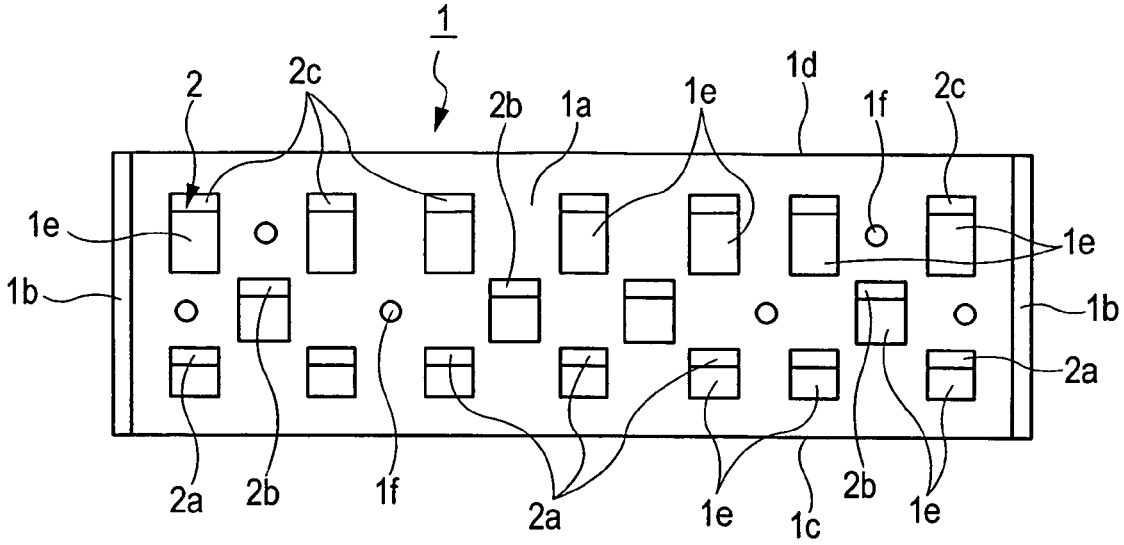
FIG. 1 is a plan view of a heat-dissipating member according to a first embodiment of the present invention.
Figure 2:
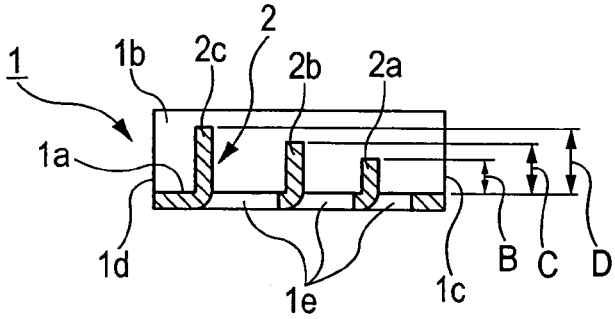
FIG. 2 is a sectional view of a principal part of the heat-dissipating member shown in FIG. 1.

Embodiments of the present invention will now be described with reference to the accompanying drawings. FIG. 1 is a plan view of a heat-dissipating member 1 according to a first embodiment of the present invention. FIG. 2 is a sectional view of a principal part of the heat-dissipating member 1 shown in FIG. 1.

With reference to FIG. 1, the heat-dissipating member 1 is made of a metal plate, such as an aluminum plate, having high heat conductivity and good heat-dissipating properties and includes a straight heat-dissipating section 1*a* having a large area and side walls 1*b* which are opposed to each other and which extend perpendicularly from both ends of the heat-dissipating section 1*a*.

The heat-dissipating section 1*a* has an upper end portion 1*c* and a lower end portion 1*d* opposed to the upper end portion 1*c* and has substantially a rectangular shape.

The heat-dissipating member 1 further includes heat-dissipating projections 2 formed by louvering the heat-dissipating section 1*a* using a press or the like. The heat-dissipating projections 2 extend from the heat-dissipating section 1*a* and have predetermined heights. The heat-dissipating section 1*a* has openings 1*e* formed by forming the heat-dissipating projections 2.

The heat-dissipating projections 2 are categorized into first heat-dissipating projections 2*a*, second heat-dissipating projections 2*b*, and third heat-dissipating projections 2*c*. With reference to FIG. 1, the first heat-dissipating projections 2*a* are arranged in a first row located close to the upper end portion 1*c*, the second heat-dissipating projections 2*b* are arranged in a second row, and the third heat-dissipating projections 2*c* are arranged in a third row located close to the lower end portion 1*d*.

With reference to FIG. 2, the first heat-dissipating projections 2*a* have a height B, the second heat-dissipating projections 2*b* have a height C greater than the height B of the first heat-dissipating projections 2*a*, and the third heat-dissipating projections 2*c* a height D greater than the height C of the second heat-dissipating projections 2*b*. That is, the height C of the second heat-dissipating projections 2*b* is greater than the height B of the first heat-dissipating projections 2*a* and the height D of the third heat-dissipating projections 2*c* is greater than the height C of the second heat-dissipating projections 2*b*. The first to third heat-dissipating projections 2*a* to 2*c* have heights of about 1 to 3 mm.

The heat-dissipating projections 2 may be arranged in two rows or four or more rows as required.

With reference to FIG. 1, the second heat-dissipating projections 2*b* are alternately arranged with respect to the first and third heat-dissipating projections 2*a* and 2*c*.

That is, the heat-dissipating projections 2 present in a plurality of rows adjacent to each other are alternately arranged.

The heat-dissipating section 1*a* of the heat-dissipating member 1 is attached to a head support member 14 attached to a head mount 13 for mounting a thermal head 12 included in a thermal transfer printer 10 that is a heat source as described below.

High-temperature heat generated from the thermal head 12 during printing is conducted to the heat-dissipating member 1 through the head mount 13 and the head support member 14 and then dissipated from the heat-dissipating projections 2, whereby the thermal head 12 is efficiently cooled indirectly.

The heat-dissipating projections 2 may be arranged in N rows in increasing order of height such that the heat-dissipating projections 2 present in the Nth row are tallest. Therefore, if an air blower 24 described below is placed on the side of the upper end portion 1*c* located close to the first heat-dissipating projections 2*a* which are lowest, air can be uniformly applied to all of the heat-dissipating projections 2 from the air blower 24, whereby the heat-dissipating member 1 can be properly cooled.

Since the openings 1*e* formed by forming the heat-dissipating projections 2 are arranged in the heat-dissipating section 1*a*, the head support member 14 exposed through the openings 1*e* is cooled by the air fed from the air blower 24 to the heat-dissipating projections 2, whereby the thermal head 12 is indirectly cooled.

Since the first and second heat-dissipating projections 2*a* and 2*b* present in the adjacent rows are alternately arranged, the air fed from the air blower 24 can be uniformly applied to the heat-dissipating projections 2, whereby the heat-dissipating member 1 can be efficiently cooled.

Figure 3:
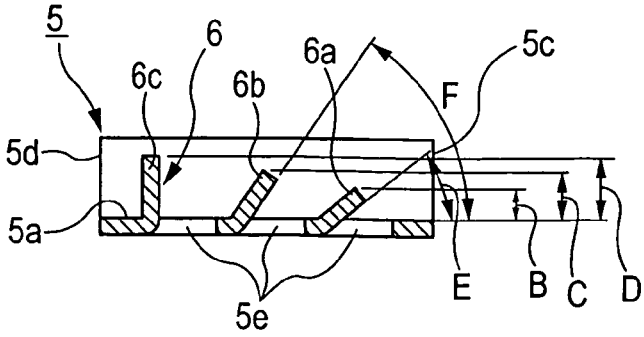
FIG. 3 is a sectional view of a principal part of a heat-dissipating member according to a second embodiment of the present invention.

FIG. 3 is a sectional view of a principal part of a heat-dissipating member 5 according to a second embodiment of the present invention. This heat-dissipating member 5, as well as the heat-dissipating member 1 of the first embodiment, is made of a metal plate, such as an aluminum plate, having high heat conductivity and good heat-dissipating properties and includes a straight heat-dissipating section 5*a* and a plurality of heat-dissipating projections 6 extending therefrom. This heat-dissipating member 5 has a first end portion 5*c* and a second end portion 5*d* opposed thereto. These heat-dissipating projections 6 are arranged in, for example, three rows parallel to these first and second end portions 5*c* and 5*d* as shown in FIG. 3.

These heat-dissipating projections 6 have been formed by louvering this heat-dissipating section 5*a* using a press or the like.

These heat-dissipating projections 6 are categorized into first heat-dissipating projections 6*a*, second heat-dissipating projections 6*b*, and third heat-dissipating projections 6*c*. These first heat-dissipating projections 6*a* are arranged in a first row located close to this first end portion 5*c*, these second heat-dissipating projections 6*b* are arranged in a second row, and these third heat-dissipating projections 6*c* are arranged in a third row located close to this second end portion 5*d*. These first heat-dissipating projections 6*a* make a tilt angle E with respect to this heat-dissipating section 5*a* and these second dissipating projections 6*b* make a tilt angle F with respect to this heat-dissipating section 5*a*. The tilt angle F between each second heat-dissipating projection 6*b* and this heat-dissipating section 5*a* is greater than the tilt angle E between each first heat-dissipating projection 6*a* and this heat-dissipating section 5*a*. These third heat-dissipating projections 6*c* make substantially a right angle with respect to this heat-dissipating section 5*a*.

In this heat-dissipating member 5, these first to third heat-dissipating projections 6*a* to 6*c* are arranged in increasing order of tilt angle. The tilt angle E between each first heat-dissipating projection 6*a* and this heat-dissipating section 5*a* is equal to about 45 degrees and the tilt angle F between each second heat-dissipating projection 6*b* and this heat-dissipating section 5*a* is equal to about 60 degrees. This heat-dissipating section 5*a* has openings 5*e* formed by forming these heat-dissipating projections 6.

Since these heat-dissipating projections 6 make different tilt angles with this heat-dissipating section 5*a*, these first to third heat-dissipating projections 6*a* to 6*c* as well as those of the first embodiment are arranged in increasing order of height. These third heat-dissipating projections 6*a* are tallest.

If the air blower 24 described below is placed on the side of this first end portion 5*c*, air can be introduced into these openings 5*e* from the air blower 24 such that this thermal head 12 is cooled directly or indirectly.

In this heat-dissipating member 5, these second heat-dissipating projections 6*b* as well as those of the first embodiment are alternately arranged with respect to these first to third heat-dissipating projections 6*a* to 6*c*.

Figure 4:
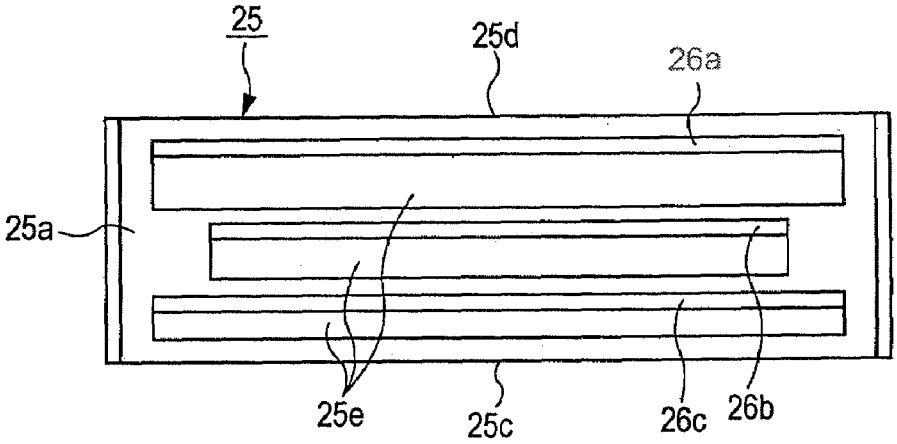
FIG. 4 is a plan view of a heat-dissipating member according to a third embodiment of the present invention.

FIG. 4 is a plan view of a heat-dissipating member 25 according to a third embodiment of the present invention. This heat-dissipating member 25 is made of a metal plate, such as an aluminum plate, having good heat-dissipating properties and includes a straight heat-dissipating section 25*a* and a plurality of lateral heat-dissipating projections 26, formed by louvering this heat-dissipating section 25*a*, perpendicular to this heat-dissipating section 25*a*. This heat-dissipating member 25 has a first end portion 25*c* and a second end portion 25*d* parallel thereto. These heat-dissipating projections 26 are parallel to these first and second end portions 25*c* and 25*d* and are categorized into a first heat-dissipating projection 26*a*, a second heat-dissipating projection 26*b*, and a third heat-dissipating projection 26*c*.

This first heat-dissipating projection 26*a* is located close to this first end portion 25*c* and this third heat-dissipating projection 26*c* is located close to this second end portion 25*d*. These first to third heat-dissipating projections 26*a* to 26*c* as well as those of the first embodiment are arranged in increasing order of height and this third heat-dissipating projection 26*c* is tallest.

This heat-dissipating section 25*a* has openings 25*e* formed by forming these first to third heat-dissipating projection 26*a* to 26*c*.

This heat-dissipating member 25 as well as that of the first or second embodiment is useful in cooling this thermal head 12 properly and efficiency.

Figure 5:
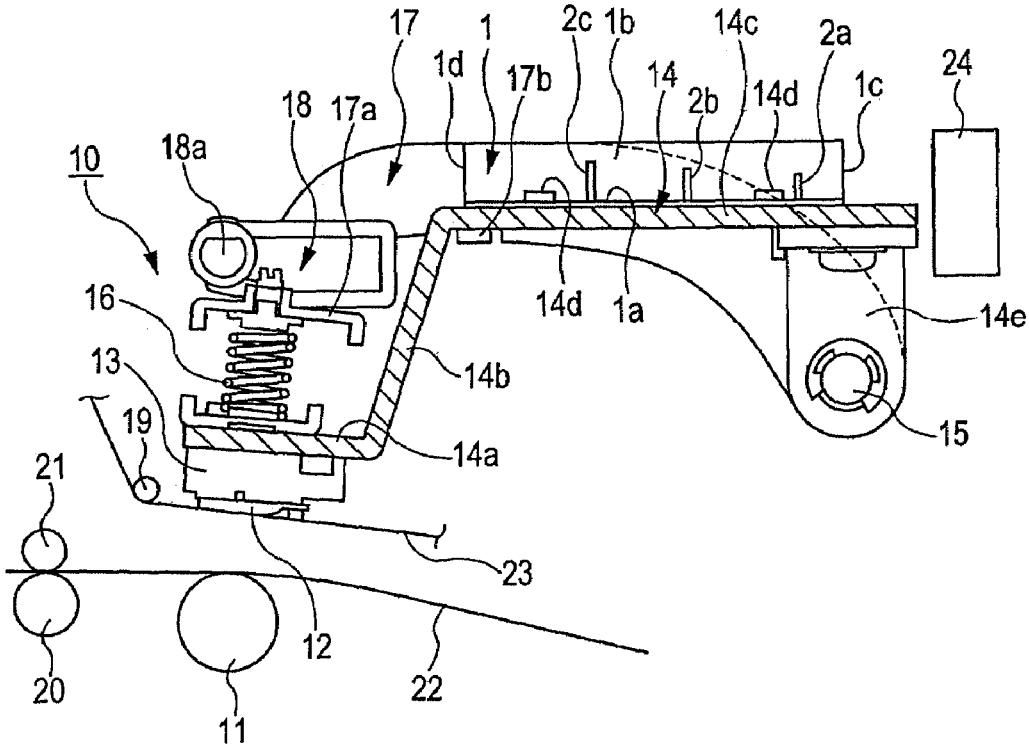
FIG. 5 is a sectional view of a principal part of a thermal transfer printer including a thermal head according to the present invention.
Figure 6:
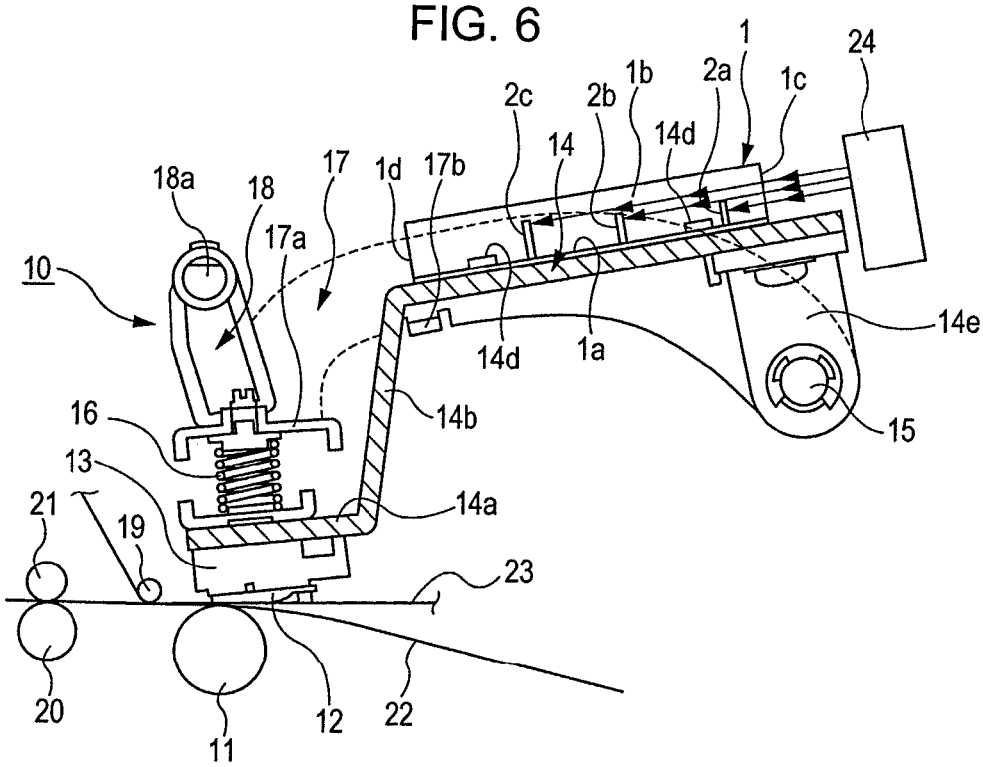
FIG. 6 is a sectional view illustrating the operation of the thermal transfer printer shown in FIG. 5.
Figure 7:
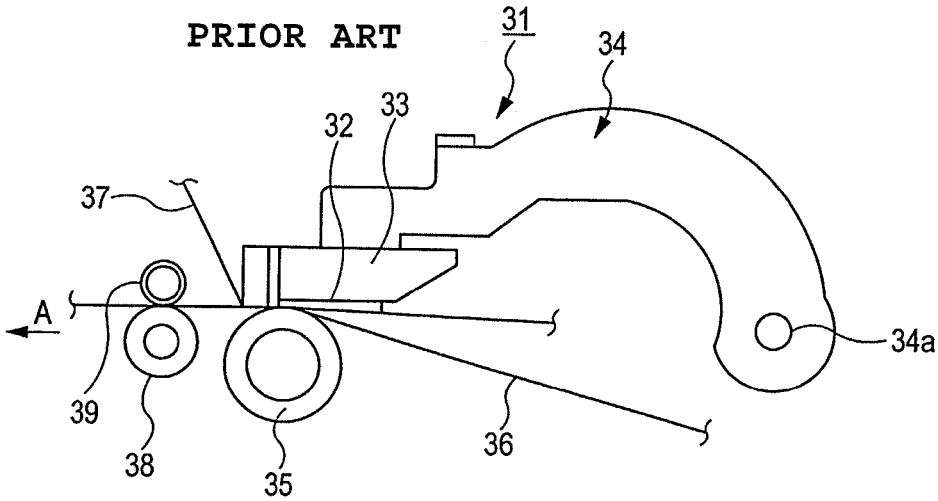
FIG. 7 PRIOR ART
FIG. 7 is a schematic view of a thermal transfer printer including a known thermal head.

FIG. 5 is a sectional view of a principal part of the thermal transfer printer 10 including the thermal head 12 according to the present invention. FIG. 6 is a sectional view illustrating the operation of the thermal transfer printer 10 shown in FIG. 5. The thermal transfer printer 10 further includes a body case (not shown) and a rotatable, cylindrical platen roller 11 disposed below the body case.

The thermal head 12 is elongate and is a type of line head. The thermal head 12 is disposed above the platen roller 11 in parallel to the axis of the platen roller 11. The thermal head 12 has a face opposed to the platen roller 11 and includes a plurality of heating elements (not shown) arranged on the opposed face in the longitudinal direction of the thermal head 12. The thermal head 12 is attached to the head support member 14 with the head mount 13 made of a metal material, such as aluminum, having high heat conductivity.

The head support member 14 is made of a metal material, such as aluminum, having high heat conductivity and has a predetermined thickness. The head support member 14 has a crank shape in cross section as shown in FIG. 5.

The head support member 14 includes a head support section 14*a* which is located close to the left end of the head support member 14 and which is attached to the head mount 13, a slope section 14*b* which extends from the head support section 14*a* to the right and which is bent so as to have a crank shape, and a flat section 14*c*.

A plurality of engaging projections 14*d* extend from the flat section 14*c*. The heat-dissipating section 1*a* of the heat-dissipating member 1 is tightly attached to the flat section 14*c* in such a manner that the engaging projections 14*d* are inserted into engaging holes 1*f*, shown in FIG. 1, arranged in the heat-dissipating member 1 and then caulked.

Even if the thermal head 12 is heated to a high temperature during printing, the heat of the thermal head 12 is conducted to the head mount 13 and then the head support member 14 and then dissipated from the heat-dissipating member 1.

The heat-dissipating member 1 is attached to the flat section 14*c* of the head support member 14 such that the upper end portion 1*c* of the heat-dissipating member 1 is located on the right in FIG. 5 and the lower end portion 1*d* thereof is located on the left in FIG. 5.

The head support member 14 is attached to a support arm 14*e* extending downward from the right end of the flat section 14*c*. The support arm 14*e* is swingably supported on a support axis 15 linked with the body case (not shown).

Therefore, the thermal head 12 can be brought into contact with or separated from the platen roller 11, that is, the thermal head 12 can be put into a head-up mode or a head-down mode in such a manner that the head support member 14 is swung about the support axis 15.

The lower end of a coil spring 16 is supported on the head support section 14*a* of the head support member 14 and the upper end of the coil spring 16 is linked to a pressing plate 17*a* attached to the left ends of a pair of swing arms 17 such that the coil spring 16 urges the swing arms 17 away from the head support section 14*a*.

The pressing plate 17*a* is elongate and extends along the longitudinal direction of the thermal head 12. Both ends of the pressing plate 17*a* are fixed to the left ends of the swing arms 17.

The pressing plate 17*a* can be vertically move because right end portions of the swing arms 17 are supported with the support axis 15 and the swing arms 17 are swung about the support axis 15.

The swing arms 17 swung about the support axis 15 is consistently spring-urged upwardly with an elastic member (not shown) other than the coil spring 16.

The swing arms 17 each include corresponding holding sections 17*b* formed by louvering the swing arms 17. The head support member 14 is held with the holding sections 17*b* and spring-urged upwardly because the swing arms 17 are spring-urged upwardly.

The swing arms 17 can be vertically moved in such a manner that the pressing plate 17*a* is pressed with a cam member 18 rotatably supported on a support axis 18*a* located close to the body case.

Since portions of the swing arms 17 that are located close to the pressing plate 17*a* are vertically moved, the head support section 14*a* of the head support member 14 is vertically moved with the coil spring 16 disposed between the pressing plate 17*a* and the head support section 14*a*.

A separating roller 19 that can be vertically moved in association with the vertical movement of the thermal head 12 is disposed on the left side of the thermal head 12.

A sheet-feeding roller 20 and a pressing roller 21 for pressing the sheet-feeding roller 20 are disposed on the left side of the platen roller 11.

A recording sheet 22 is fed between the platen roller 11 and the thermal head 12 in the head-up mode in the right direction (the upstream direction) or the left direction (the downstream direction). The recording sheet 22 can be fed in the upstream or downstream direction by driving the sheet-feeding roller 20 in such a situation that the recording sheet 22 is sandwiched between the sheet-feeding roller 20 and the pressing roller 21.

An ink ribbon 23 extends above the recording sheet 22 fed between the thermal head 12 and the platen roller 11.

The ink ribbon 23 is brought into contact with the recording sheet 22 by lowering the thermal head 12, separated therefrom with the separating roller 19, and then fed in the upper direction.

The air blower 24 is disposed on the side of an end 1*c* of the heat-dissipating member 1 attached to the flat section 14*c* of the head support member 14. The heat-dissipating projections 2 extending from the heat-dissipating member 1 are cooled by air fed from the air blower 24, whereby the heat of the thermal head 12 heated to a high temperature is dissipated through the head mount 13 and then head support member 14.

The printing operation of the thermal transfer printer 10 including the head mount 13 attached to the heat-dissipating member 1 will now be described. As shown in FIG. 5, the cam member 18 is rotated so as to lie horizontally, whereby the swing arms 17 are swung upwardly. Therefore, the thermal head 12 is separated from the platen roller 11 and put into the head-up mode.

The ink ribbon 23 is fed between the platen roller 11 and the thermal head 12 in the head-up mode and the recording sheet 22 is fed in the direction from the right to the left in FIG. 5, that is, the downstream direction.

After a leading end portion of the recording sheet 22 is sandwiched between the sheet-feeding roller 20 and the pressing roller 21, the cam member 18 is rotated clockwise.

As shown in FIG. 6, the pressing plate 17*a* is pressed downward by the rotation of the cam member 18. Therefore, the swing arms 17 are swung downward and the thermal head 12 is lowered down, whereby the ink ribbon 23 and the recording sheet 22 are pressed against the platen roller 11.

In such a situation, the heating elements of the thermal head 12 are selectively heated depending on printing information and the recording sheet 22 is fed in the downstream direction by driving the sheet-feeding roller 20, whereby ink on the ink ribbon 23 is thermally transferred to the recording sheet 22 and a desired image is therefore printed on the recording sheet 22.

If such a printing operation is continued using a plurality of recording sheets, the thermal head 12 that is a heat source is heated to a high temperature. The high-temperature heat of the thermal head 12 is conducted to the heat-dissipating member 1 through the head mount 13 and the head support member 14.

The heat-dissipating member 1 is heated by the conducted heat and the heat of the heat-dissipating member 1 is efficiently dissipated from the heat-dissipating projections 2.

Since the air blower 24 is disposed on the side of the end 1*c* of the heat-dissipating member 1, air fed from the air blower 24 cools the first to third heat-dissipating projections 2*a* to 2*c*; hence, the thermal head 12 can be maintained at a temperature suitable for printing.

The air fed from the air blower 24 flows through the openings 1*e* to cool the head support member 14 exposed through the openings 1*e*; hence, the thermal head 12 heated to a high temperature can be properly cooled during printing. Therefore, even if the thermal head 12 is repeatedly subjected to continuous printing, the thermal head 12 can be maintained at a temperature lower than a predetermined temperature, thereby preventing the deterioration of printing quality.

In the above description, the thermal head 12 includes the heat-dissipating member 1 according to the first embodiment; however, the thermal head 12 may include the heat-dissipating member 5 according to the second embodiment or the heat-dissipating member 25 according to the third embodiment.

The heat-dissipating section 1*a* of the heat-dissipating member 1 is straight; however, the heat-dissipating section 1*a* may be L-shaped, that is, the heat-dissipating section 1*a* shown in FIG. 5 may have a right end portion which extends from the end 1*c* of the heat-dissipating member 1 to the right and bends downward.

This leads to an increase in the heat dissipation area of the heat-dissipating member 1, resulting in efficient heat dissipation.

The air blower 24 is automatically turned on by turning on the thermal transfer printer 10. The air blower 24 may be controlled using a temperature sensor attached thereto such that the air blower 24 is not operated when the temperature of the air blower 24 is less than a predetermined value but is operated when the temperature of the air blower 24 is a predetermined value or more.

In the heat-dissipating member 1, the first to third heat-dissipating projections 2*c* have different heights and are arranged in increasing order of height. However, the first to third heat-dissipating projections 2*c* have the same height.

The heat-dissipating projections 2 may be formed by louvering the heat-dissipating section 1*a* so as to have a predetermined height.

In the first or second embodiment, the heat-dissipating projections 2 or 5 are arranged in three rows; however, the heat-dissipating projections 2 or 5 may be arranged in two rows or four or more rows as required.

What is claimed is:

1. A heat-dissipating member comprising:

a heat-dissipating section which is plate-shaped and which is attachable to a heat source directly or indirectly; and a plurality of heat-dissipating projections extending from the heat-dissipating section, wherein the heat-dissipating projections are formed by louvering the heat-dissipating section so as to have predetermined heights in the direction from one end of the heat-dissipating section to the opposed end thereof so that the heat dissipation areas of the plurality of heat-dissipating projections gradually increase in the direction form the one end to the opposed end.

2. The heat-dissipating member according to claim 1, wherein the heat-dissipating projections are arranged in N rows parallel to the one end of the heat-dissipating section, the rows are N rows (N ≧), and the heat dissipation areas of the projections arranged in the N rows gradually increase from the projections in the firms row near the one end to the projections in the Nth row near the opposed end.

3. The heat-dissipating member according to claim 2, wherein the heat-dissipating projections present in the N rows adjacent to each other are alternately arranged.

4. The heat-dissipating member according to claim 1, wherein the heat-dissipating projections make different tilt angles with respect to the heat-dissipating section, are arranged in increasing order of tilt angle in the direction from the one end of the heat-dissipating section to the opposed end such that the heat-dissipating projections located close to the opposed end make a right angle with respect to the heat-dissipating section, and are arranged in increasing order of height in the direction from the one end of the heat-dissipating section to the opposed end.

5. The heat-dissipating member according to claim 4, wherein the heat-dissipating projections present in the first row make a tilt angle of 45 degrees with respect to the heat-dissipating section and the heat-dissipating projections present in the Nth row make a right angle with respect to the heat-dissipating section.

6. A thermal head comprising:

a plurality of heating elements arranged thereon; and a head mount attached to the heat-dissipating member according to claim 1 directly or indirectly.

7. The thermal head according to claim 6, wherein an air blower is disposed near the one end of the heat-dissipating section and air is applied to the heat-dissipating projections, arranged in increasing order of height in the direction from the one end of the heat-dissipating section to the opposed end, from the air blower, whereby the heat-dissipating section and then the head mount are cooled.

8. The thermal head according to claim 7, wherein the heat-dissipating section has openings formed by forming the heat-dissipating projections and a head support member is exposed through the openings so that the head mount is cooled by the air fed from the air blower through the openings.

* * * * *

UNITED STATES PATENT AND TRADEMARK OFFICE

CERTIFICATE OF CORRECTION

PATENT NO. : 7,477,277 B2
APPLICATION NO. : 11/303110
DATED : January 13, 2009
INVENTOR(S) : Tsuneyuki Sasaki et al.

It is certified that error appears in the above-identified patent and that said Letters Patent is hereby corrected as shown below:

In the Claims

In column 9, claim 1, line 46, before "the one end to" delete "form" and substitute --from-- in its place.

Signed and Sealed this

Thirtieth Day of June, 2009

JOHN DOLL
*Acting Director of the United States Patent and Trademark Office*